US011359835B1

(12) United States Patent
Lu et al.

(10) Patent No.: US 11,359,835 B1
(45) Date of Patent: Jun. 14, 2022

(54) VARIABLE LOUVER CONTROL FOR FANS

(71) Applicant: Arista Networks, Inc., Santa Clara, CA (US)

(72) Inventors: Duong Cu Lu, Hayward, CA (US); Robert Morris Wilcox, Saratoga, CA (US); Richard Neville Hibbs, Redwood City, CA (US); Ian Christopher Fry, The Woodlands, TX (US)

(73) Assignee: Arista Networks, Inc., Santa Clara, CA (US)

( * ) Notice: Subject to any disclaimer, the term of this patent is extended or adjusted under 35 U.S.C. 154(b) by 0 days.

(21) Appl. No.: 17/148,310

(22) Filed: Jan. 13, 2021

(51) Int. Cl.
*F24F 13/14* (2006.01)

(52) U.S. Cl.
CPC .... *F24F 13/1413* (2013.01); *F24F 2013/146* (2013.01)

(58) Field of Classification Search
CPC ..... F24F 13/1413; F24F 2013/146; F24F 11/745; F04D 25/14
USPC ..... 431/184, 311, 259, 353, 359
See application file for complete search history.

(56) References Cited

U.S. PATENT DOCUMENTS 6,011,689 A * 1/2000 Wrycraft ..... G06F 1/20 361/679.31
8,668,435 B2 * 3/2014 Weisser ..... F04D 25/14 415/26
10,624,241 B1 4/2020 Ross et al.
2020/0116385 A1 4/2020 Tsai et al.

FOREIGN PATENT DOCUMENTS

CN 204851717 U 12/2015
CN 109026800 A 12/2018

OTHER PUBLICATIONS

International Search Report and Written Opinion for PCT/US2022/012276, dated Apr. 12, 2022, 12 pages.

* cited by examiner

*Primary Examiner* — Vivek K Shirsat
(74) *Attorney, Agent, or Firm* — Chamberlain, Hrdlicka, White, Williams & Aughtry

(57) ABSTRACT

Systems for controlling louver positions are described herein. Such systems may include: a louver frame; a louver coupled to the louver frame via a rotation member and adapted to rotate at a louver side around an axis of rotation at the rotation member. In one embodiment, the louver includes a spring member engagement feature. The system also includes a spring member coupled to the louver frame and adapted to engage with the spring member engagement feature of the louver and apply a force to the louver when a forward airflow is applied to the louver in a forward airflow direction.

20 Claims, 10 Drawing Sheets

VARIABLE LOUVER CONTROL FOR FANS

BACKGROUND

Devices and/or components therein often generate heat during operation. Fans are often used to provide cooling to such devices and/or components. In certain scenarios, cooling airflow created by a fan is intended to generally flow in a given direction. In such scenarios, airflow in a reverse direction may reduce or eliminate the cooling provided by a fan. To mitigate, at least in part, problems associated with reverse airflow, louvers may be used that open to varying degrees when subjected to forward airflow, and close when subjected to reverse airflow. The action of the louvers may allow forward airflow, while preventing, at least in part, the negative effects that may occur due to reverse airflow. Louvers may have an equilibrium angle of opening for a given airflow rate. However, louvers often have a tendency to oscillate around that angle. Such oscillations may cause wear and tear on the louver system, and may eventually lead to such a system breaking. In such a scenario, the louvers may no longer operate to prevent, in part or in whole, the reverse airflow, as intended.

DETAILED DESCRIPTION

Figure 1A:
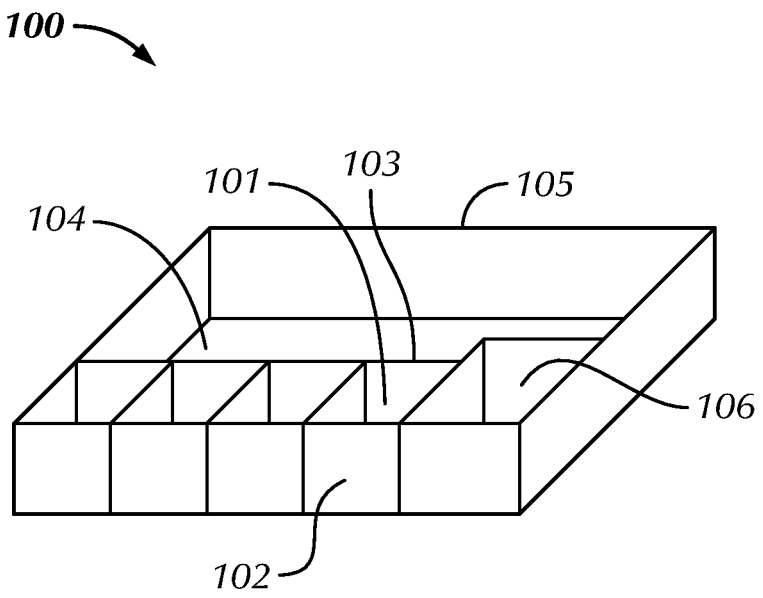
FIG. 1A shows a perspective view of a device chassis with locations for fan modules and louvers in accordance with one or more embodiments described herein.

Specific embodiments will now be described with reference to the accompanying figures.

In general, embodiments described herein relate to systems for controlling louver position when louvers are subjected to variable airflow speeds. In one or more embodiments, the system includes a louver frame adapted to be coupled to a fan module. In one or more embodiments, the louver frame supports louvers coupled to the louver frame on one side to provide an axis of rotation.

In one or more embodiments, in the absence of airflow in the forward direction provided by the fan, or when the airflow is in a reverse direction, the louvers close (i.e., they are positioned orthogonal to the intended airflow direction to prevent reverse airflow). In one or more embodiments, when the fan provides a forward airflow, the louvers open. In one or more embodiments, how much they open depends on the flow rate and the position of the louver relative to the fan.

In one or more embodiments, at any louver position within a set of louvers, at a given airflow rate, there is an equilibrium angle to which the louver should open. However, current louver solutions tend to oscillate around the equilibrium angle, which causes the mechanical features that allow louver rotation to wear out, which may lead to an unwanted reverse airflow that negatively affects cooling. It may be possible to add hard stops to reduce or prevent oscillation. However, the location of such hard stops for the louvers must be determined once the airflow profile is known, which may differ even from a single fan. For example, the upper and lower louvers on a louver frame may be subjected to a higher airflow than the louvers on the middle, because the fan to which the louver frame is attached my cause less airflow in the middle than it does at the edges. Moreover, to reduce or prevent oscillation, such hard stops may be located such that the angle to which the louvers are able to open is less than the optimum angle, which reduces the airflow, and thus the cooling, provided by the fan. Alternatively, such hard stops may be placed at an angle larger than the equilibrium angle, thereby still allowing at least some of the unwanted oscillation.

In one or more embodiments, embodiments described herein address the aforementioned oscillation problem by using a spring member as part of the louver frame that engages with an engagement feature on the louver to apply a variable force to the louver to prevent such oscillation. In one or more embodiments, the spring member applies a force to the louver to induce a counter moment that dampens out the oscillation. In one or more embodiments, the spring member also changes the louver natural frequency and provides a friction force at the louver and spring member contact point that helps reduce the oscillation In one or more embodiments, the amount of force applied by the spring member is calibrated based on experimentation that yields what the material properties of the spring member and its placement need to be to apply an appropriate amount of force at a given airflow speed to dampen oscillation while allowing louvers to open to an equilibrium angle.

Alternate embodiments may have the spring member as part of the louver and the engagement feature as part of the louver frame, or a spring coupled to the louver and the louver frame, to achieve the same or similar result.

FIG. 1A shows a perspective view of a device chassis with locations for fan modules and louvers in accordance with one or more embodiments described herein. The devices/components shown in FIG. 1A and described below are each only one example of a particular device/component. One having ordinary skill in the art, and the benefit of this Detailed Description, will appreciate that the techniques described herein may apply to any number of different devices. Accordingly, embodiments described herein should not be considered limited to devices/components shown in FIG. 1A.

As shown in FIG. 1A, device chassis (100) includes at least one bay (e.g., bay (101)), first opening (102), second opening (103), interior of the device chassis (104), and front of the device chassis (105). Each of these components is described below.

In one or more embodiments, device chassis (100) is a component of a device that houses any number of components that are part of and/or operatively connected to the device. FIG. 1A shows a perspective view of the rear of device chassis (100).

In one or more embodiments, device chassis (100) includes at least one bay (101). In one or more embodiments, bay (101) is disposed at the rear of device chassis (100). Although shown at the rear of the device in FIG. 1A, a bay may be located in any location within a device. In one or more embodiments, bay (101) is adapted to hold a fan module (not shown) and a louver frame (not shown) coupled to the fan module (not shown) and including one or more louvers (not shown). Fan modules, louver frames, and louvers are discussed in greater detail in the descriptions of FIGS. 1C-9, below. In one or more embodiments, device chassis (100) includes any number of such bays for holding fan modules and louver frames. In one or more embodiments, all such bays include a fan module and a louver frame. Additionally or alternatively, one or more bays may not include a fan module and louver frame. In such embodiments, a component may be inserted into the bay to prevent and/or reduce any unwanted airflow into or out of the bay having no fan module or louver frame.

In one or more embodiments, bay (101) includes first opening (102). In one or more embodiments, first opening (102) opens to the outside of device chassis (100). In one or more embodiments, first opening (102) forms part of an airflow pathway for air to flow out of and/or into the chassis, depending on the intended airflow direction implemented by the fan module (not shown) that is disposed within bay (101).

In one or more embodiments, bay (101) includes second opening (103). In one or more embodiments, second opening (103) opens to the interior of the device chassis (104). In one or more embodiments, second opening (103) forms part of an airflow pathway for air to flow out of and/or into the chassis, depending on the intended airflow direction implemented by the fan module (not shown) that is disposed within bay (101).

In one or more embodiments, device chassis (100) also includes interior of the device chassis (104). In one or more embodiments, interior of the device chassis (104) includes any components used in any way by the device of which device chassis (100) is a component. For example, the device may be a network device or may be any device capable of sending and/or receiving data, which may be any form of a packet (or other network traffic data such as e.g., Internet Protocol (IP) packets, Media Access Control (MAC) frames, Virtual eXtensible Local Area Network (VXLAN) frames, etc.), such as a computing device.

In one or more embodiments, a computing device is any device or any set of devices capable of electronically processing instructions and may include, but is not limited to, any of the following: one or more processors (e.g. components that include integrated circuitry) (not shown), memory (e.g., random access memory (RAM) (not shown)), input and output device(s) (not shown), persistent storage, one or more physical interfaces (e.g., network ports) (not shown), any number of other hardware components (not shown) and/or any combination thereof.

Examples of computing devices include, but are not limited to, a server (e.g., a blade-server in a blade-server chassis, a rack server in a rack, etc.), a desktop computer, a mobile device (e.g., laptop computer, smart phone, personal digital assistant, tablet computer and/or any other mobile computing device), a network device (e.g., switch, router, multi-layer switch, etc.) such as that described below, a virtual machine executing using underlying hardware components of a physical computing device, and/or any other type of computing device with the aforementioned requirements.

In one or more embodiments, as discussed above, one type of a computing device as described herein is a network device. In one or more embodiments, a network device is a physical device that includes and/or is operatively connected to persistent storage (not shown), memory (e.g., random access memory (RAM)) (not shown), one or more processor(s) (e.g., integrated circuits) (not shown), and at least one physical network interface (not shown). Examples of a network device include, but are not limited to, a network switch, a router, a multilayer switch, a fibre channel device, an InfiniBand® device, etc. A network device is not limited to the aforementioned specific examples.

In one or more embodiments, a network device also includes any number of additional components (not shown), such as, for example, circuit boards, network chips, field programmable gate arrays (FPGAs) (not shown), application specific integrated circuits (ASICs) (not shown), indicator lights (not shown), fans (not shown), clocks (not shown), etc. In one or more embodiments, all or any portion of such components may require at least some cooling to be provided at certain times.

In one or more embodiments, all or any portion of the components of a device (e.g., a network device) may be located within interior of device chassis (104) shown in FIG. 1A. In one or more embodiments, any or all such components may generate heat, and, as such, may be cooled by one or more fan modules (not shown) coupled to louver frames and disposed in the bays (e.g., bay (101)) of device chassis (100).

In one or more embodiments, a network device includes functionality to send and/or receive packets (or other network traffic data, such as, e.g., frames, etc.) at any of the physical network interfaces (i.e., ports) of the network device and to process the packets. In one or more embodiments, processing a packet includes, but is not limited to, a series of one or more table lookups (e.g., longest prefix match (LPM) lookups, forwarding equivalence class (FEC) lookups, etc.) and corresponding actions (e.g., forward from a certain egress port, add a labeling protocol header, rewrite a destination address, encapsulate, etc.). Such a series of lookups and corresponding actions may be referred to as a pipeline, and may be, for example, programmed as a match-action pipeline. Examples of pipeline processing include, but are not limited to, performing a lookup to determine: (i) whether to take a security action (e.g., drop the network traffic data unit); (ii) whether to mirror the network traffic data unit; and/or (iii) how to route/forward the packet in order to transmit the packet from an interface of the network device.

In one or more embodiments, the network device is part of a network (not shown). A network (not shown) may refer to an entire network or any portion thereof (e.g., a logical portion of the devices within a topology of devices). A network may include a datacenter network, a wide area network, a local area network, a wireless network, a cellular phone network, or any other suitable network that facilitates the exchange of information from one part of the network to another. A network may be located at a single physical location, or be distributed at any number of physical sites. In one or more embodiments, a network may be coupled with or overlap, at least in part, with the Internet. In one or more embodiments, any or all devices within and/or connected to a network may have chassis' having bays for fan modules and louver frames configured to cool device components.

In one or more embodiments, device chassis (100) also includes front of device chassis (105). In one or more embodiments, front of device chassis (105) is located at a side of the device opposite of the side at which the bays (e.g., bay (101)) are located. In one or more embodiments, front of device chassis (105) includes one or more openings (not shown) that allow for air flow into or out of device chassis (100).

As an example, a fan module in a bay (e.g., bay (101)) may rotate to cause an airflow in a direction generally from front of device chassis (105), through interior of device chassis (104), through second opening (103), through bay (101), and out of second opening (103) to the exterior of the device chassis (100). In such an example, a louver frame disposed in bay (101) may be configured to allow airflow in the intended direction (i.e., front to rear of the chassis), while preventing or reducing airflow in the reverse direction (i.e., rear to front).

As another example, a fan module in a bay (e.g., bay (101)) may rotate to cause an airflow in a direction generally from the exterior of device chassis (100), through first opening (102), through bay (101), through second opening (103), through interior of device chassis (104), and out of front of device chassis (105) to the exterior of the device chassis (100). In such an example, a louver frame disposed in bay (101) may be configured to allow airflow in the intended direction (i.e., rear to front of the chassis), while preventing or reducing airflow in the reverse direction (i.e., front to rear).

While FIG. 1A shows a configuration of components, other configurations may be used without departing from the scope of embodiments described herein. For example, the device chassis may be of any shape and/or size. As another example, rather than a computing device (e.g., a network device), one or more fan modules coupled to louver frames may be used in any scenario where airflow in one direction is desired, while airflow in a reverse direction is to be reduced or prevented. Accordingly, embodiments disclosed herein should not be limited to the configuration of components shown in FIG. 1A.

Figure 1B:
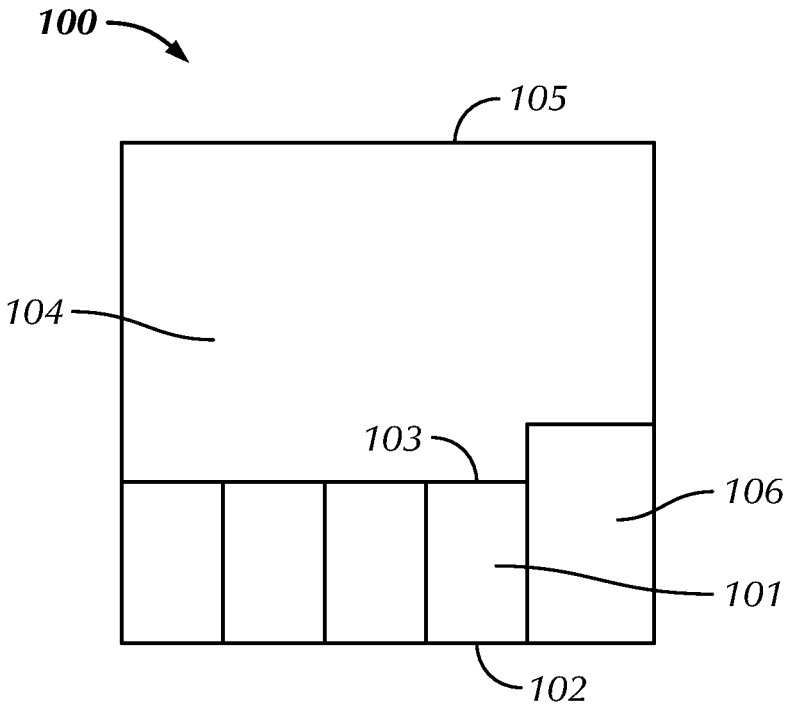
FIG. 1B shows a top view of a device chassis with locations for fan modules and louvers in accordance with one or more embodiments described herein.

FIG. 1B shows a top view of a device chassis with locations for fan modules and louvers in accordance with one or more embodiments described herein. The devices/components shown in FIG. 1B and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 1B.

As shown in FIG. 1B, device chassis (100) includes at least one bay (e.g., bay (101)), first opening (102), second opening (103), interior of the device chassis (104), front of the device chassis (105), and power supply (106). Each of these components is described below.

In one or more embodiments, device chassis (100) is a component of a device that houses any number of components that are part of and/or operatively connected to the device. FIG. 1B shows a top view of device chassis (100).

In one or more embodiments, device chassis (100) includes at least one bay (101). In one or more embodiments, bay (101) is disposed at the rear of device chassis (100). In one or more embodiments, bay (101) is adapted to hold a fan module (not shown) and a louver frame (not shown) coupled to the fan module and including one or more louvers (not shown). Fan modules, louver frames, and louvers are discussed in greater detail in the descriptions of FIGS. 1C-9, below. In one or more embodiments, device chassis (100) includes any number of such bays for holding fan modules and louver frames. In one or more embodiments, all such bays include a fan module and a louver frame. Additionally or alternatively, one or more bays may not include a fan module and louver frame. In such embodiments, a component may be inserted into the bay to prevent and/or reduce any unwanted airflow into or out of the bay having no fan module or louver frame.

In one or more embodiments, bay (101) includes first opening (102). In one or more embodiments, first opening (102) opens to the outside of device chassis (100). In one or more embodiments, first opening (102) forms part of an airflow pathway for air to flow out of and/or into the chassis, depending on the intended airflow direction implemented by the fan module (not shown) that is disposed within bay (101).

In one or more embodiments, bay (101) includes second opening (103). In one or more embodiments, second opening (103) opens to the interior of the device chassis (104). In one or more embodiments, second opening (103) forms part of an airflow pathway for air to flow out of and/or into the chassis, depending on the intended airflow direction implemented by the fan module (not shown) that is disposed within bay (101).

In one or more embodiments, device chassis (100) also includes interior of the device chassis (104). In one or more embodiments, interior of the device chassis (104) includes any components used in any way by the device of which device chassis (100) is a component. Examples of such devices (e.g., computing devices, such as network devices) are discussed above in the description of FIG. 1A.

In one or more embodiments, all or any portion of the components of a device (e.g., a network device) may be located within interior of device chassis (104) shown in FIG. 1B. In one or more embodiments, any or all such components may generate heat, and, as such, may be cooled by one or more fan modules coupled to louver frames and disposed in the bays (e.g., bay (101)) of device chassis (100).

In one or more embodiments, device chassis (100) also includes front of device chassis (105). In one or more embodiments, front of device chassis (105) is located at a side of the device opposite of the side at which the bays (e.g., bay (101)) are located. In one or more embodiments, front of device chassis (105) includes one or more openings (not shown) that allow for air flow into or out of device chassis (100).

As an example, a fan module in a bay (e.g., bay (101)) may rotate to cause an airflow in a direction generally from front of device chassis (105), through interior of device chassis (104), through second opening (103), through bay (101), and out of second opening (103) to the exterior of the device chassis (100). In such an example, a louver frame disposed in bay (101) may be configured to allow airflow in the intended direction (i.e., front to rear of the chassis), while preventing or reducing airflow in the reverse direction (i.e., rear to front).

As another example, a fan module in a bay (e.g., bay (101)) may rotate to cause an airflow in a direction generally from the exterior of device chassis (100), through first opening (102), through bay (101), through second opening (103), through interior of device chassis (104), and out of front of device chassis (105) to the exterior of the device chassis (100). In such an example, a louver frame disposed in bay (101) may be configured to allow airflow in the intended direction (i.e., rear to front of the chassis), while preventing or reducing airflow in the reverse direction (i.e., front to rear).

In one or more embodiments, device chassis (100) also includes power supply (106). In one or more embodiments, power supply (106) is a hardware component configured to provide power to components of a device, such as, for example, a fan module in a bay (e.g., bay (101)) of device chassis (100). The power received by or provided by power supply (106) may be in any form (e.g., direct current (DC), alternating current (AC)). For example, power supply (106) may receive AC from an external power source (e.g., an electrical outlet), and may convert such AC to DC for delivery to any of the components of the device While FIG. 1B shows a configuration of components, other configurations may be used without departing from the scope of embodiments described herein.

For example, the device chassis may be of any shape and/or size. As another example, rather than a computing device (e.g., a network device), one or more fan modules coupled to louver frames may be used in any scenario where airflow in one direction is desired, while airflow in a reverse direction is to be reduced or prevented. Accordingly, embodiments disclosed herein should not be limited to the configuration of components shown in FIG. 1B.

Figure 1C:
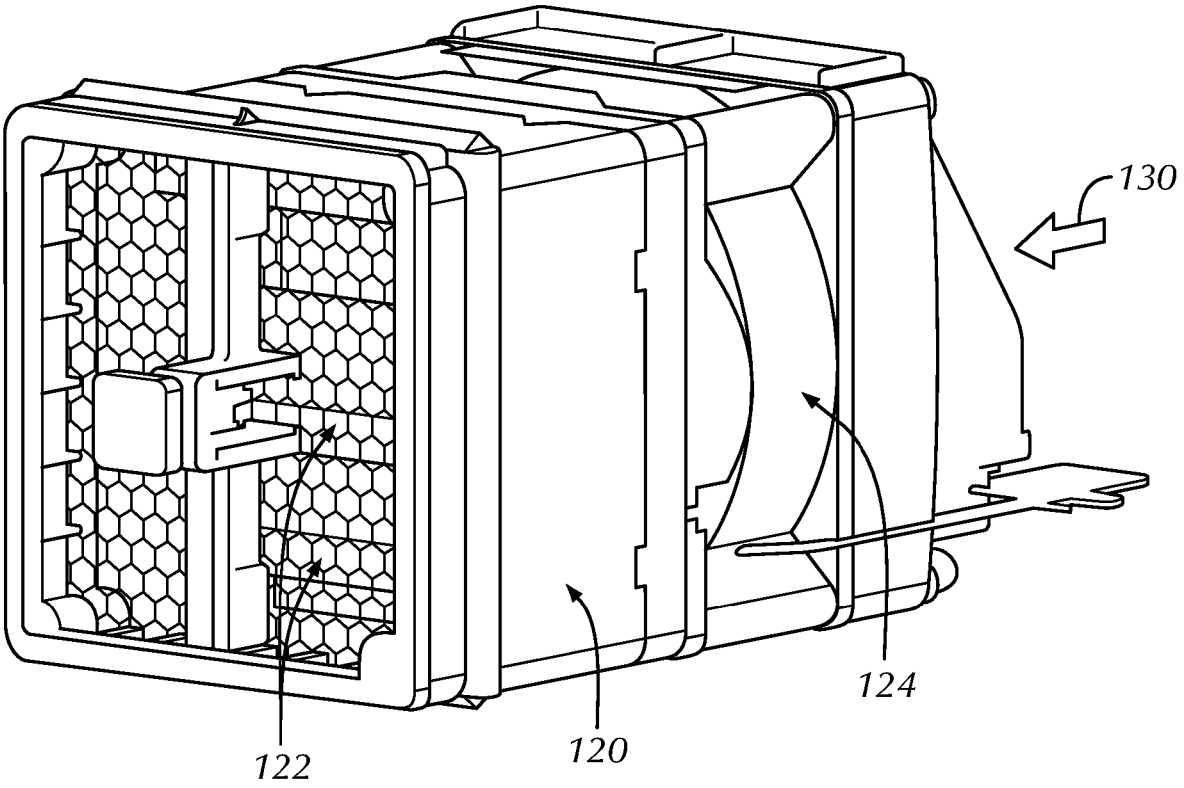
FIG. 1C shows a fan module and louvers in accordance with one or more embodiments described herein.

FIG. 1C shows a fan module coupled to a louver frame that includes louvers in accordance with one or more embodiments described herein. The devices/components shown in FIG. 1C and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 1C.

As shown in FIG. 1C, the system includes fan module (124), airflow direction (130), louver frame (120), and louvers (122). Each of these components is described below.

In one or more embodiments, fan module (124) is a hardware component that includes a physical fan (not shown). In one or more embodiments, the fan rotates in a direction (e.g., clockwise, counter clockwise). As shown in FIG. 1C, the fan in fan module (124) is configured to rotate in a direction that causes airflow in forward airflow direction (130). In one or more embodiments, forward airflow direction (130) is any airflow direction caused by the fan of fan module (124) that generally passes through fan module (124) and the fan therein, through louvers (122), and out of louver frame (120).

Although FIG. 1C shows a forward airflow direction (130) as perpendicular to fan module (124), one having ordinary skill in the art will appreciate that the forward airflow direction (130) need not be perpendicular to the fan module, and may be any direction that generally causes air to pass through the fan module and louver frame. In one or more embodiments, airflow may also be in a direction opposite forward airflow direction (130). In such embodiments, such reverse airflow may not be desired, and may be reduced or prevented by louvers (122). In other embodiments, such airflow in a reverse direction may be desired. In such embodiments, the fan of fan module (124) may be configured to create such a reverse airflow, and the louver frame (120), and louvers (122) therein, may be positioned differently than what is shown in FIG. 1C, in order to facilitate the reverse airflow direction and reduce or prevent airflow in forward airflow direction (130).

In one or more embodiments, fan module (124) is disposed within a bay (e.g., bay (101) of FIG. 1A and FIG. 1B) of a device chassis (e.g., device chassis (100) of FIG. 1A and FIG. 1B). In one or more embodiments, fan module (124) includes components configured to couple fan module (124) to one or more sides of a bay.

Fan module (124) may include, in addition to a fan (not shown), any number of other components (not shown) without departing from the scope of embodiments disclosed herein. For example, fan module (124) may include electrical connections configured to interface with a power supply (e.g., power supply (106) of FIG. 1B). As another example, fan module (124) may include components (e.g., clips, alignment features, etc.), which are adapted to couple fan module (124) to louver frame (120).

In one or more embodiments, louver frame (120) is a structure adapted to hold one or more louvers (e.g., louvers (122)). In one or more embodiments, louvers (122) are coupled to louver frame (120) via rotation members, such as, for example, hinge joints (not shown). In one or more embodiments, a rotation member is a coupling feature that allows movement of a component in one direction relative to another component. In one or more embodiments, a rotation member (not shown) creates an axis of rotation at one side of a louver, and the louver may rotate about that axis (i.e., the one direction that a louver may move when coupled to a louver frame via a hinge joint). In one or more embodiments, a rotation member (e.g., a hinge joint) allows for louvers to rotate about the axis of rotation, depending on the airflow force to which louvers may be subjected. For example, when a fan of fan module (124) rotates to cause airflow in forward airflow direction (130), the rotation members may allow louvers (122) to rotate open at an opening angle that depends on the force applied.

In one or more embodiments, the amount of rotation is dependent on the force of the airflow provided by the fan. For example, in a high airflow scenario, louvers (122) may rotate 90 degrees, becoming perpendicular to the fan and parallel to the airflow direction, thereby allowing the maximum possible airflow through the louvers (122). In one or more embodiments, in lower airflow scenarios, the hinge joint (not shown) may allow the louvers to open to smaller angles (i.e., between 0 and 90 degrees), depending on the force of the airflow. In one or more embodiments, in the absence of any airflow, louvers (122) may not open, thereby being orthogonal (or close to orthogonal) to forward airflow direction (130). In one or more embodiments, when the fan of fan module (124) is configured to provide airflow generally in forward airflow direction (130), and a scenario exists such that there is actually airflow in the reverse direction, such reverse airflow causes louvers (122) to rotate about the rotation members to become closed, thereby reducing or preventing airflow in the reverse airflow direction.

In one or more embodiments, louver frame (120) may include any number of spring members (not shown) configured to engage with spring member engagement features (not shown) of louvers (122) to dampen potential oscillation about an optimum angle of opening of louvers (122) relative to the amount of airflow provided by a fan of fan module (124). Additionally or alternatively, in one or more embodiments, louvers (122) may each include any number of spring members (not shown) configured to engage with spring member engagement features (not shown) of louver frame (120) to dampen potential oscillation about an optimum angle of opening of louvers (122) relative to the amount of airflow provided by a fan of fan module (124). Spring members and spring member engagement features are discussed further in the descriptions of FIGS. 3-9, below.

While FIG. 1C shows a configuration of components, other configurations may be used without departing from the scope of embodiments described herein. For example, the fan modules and/or louvers may be of any shape and/or size. As another example, although FIG. 1C shows a fan module positioned relative to a louver frame, any other positioning of such components relative to one another may be used. Accordingly, embodiments disclosed herein should not be limited to the configuration of components shown in FIG. 1C.

Figure 2A:
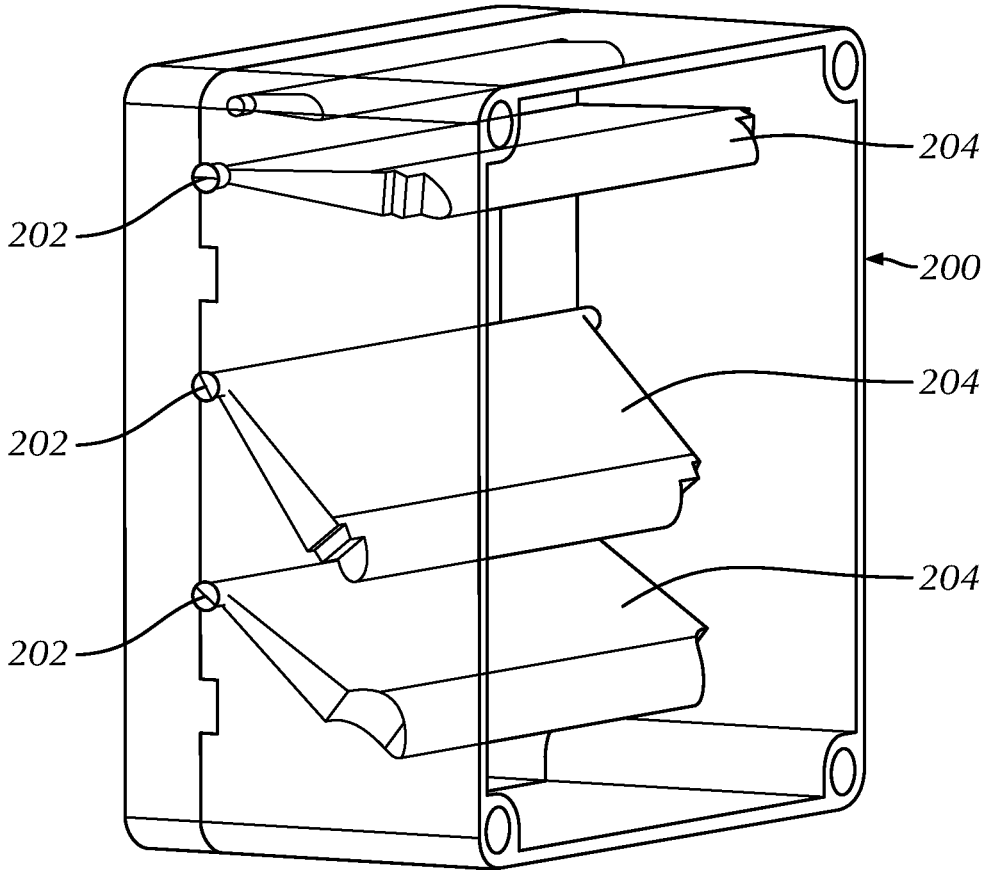
FIG. 2A shows a perspective view of louvers in a louver frame in accordance with one or more embodiments described herein.

FIG. 2A shows a louver frame in accordance with one or more embodiments described herein. The devices/components shown in FIG. 2A and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 2A.

As shown in FIG. 2A, the system includes louver frame (200), louvers (204), and rotation members (202). Each of these components is described below.

In one or more embodiments, louver frame (200) is a structure made of any material that is configured to couple to louvers (204) and a fan module (not shown). In one or more embodiments, louver frame (200) may be constructed of any material (e.g., polymer, metal, etc.) or any combination of materials. In one or more embodiments, louver frame (200) provides at least part of an airflow pathway for an airflow traveling through louvers (204). In one or more embodiments, louver frame (200) includes any number of other components (not shown) for providing a structure to which louvers (204) are coupled, and that couples to a fan module and a bay of a device chassis. In one or more embodiments, louver frame (200) and its features are constructed as a single component. In other embodiments of the invention, louver frame (200) is any number of components coupled to form louver frame (200).

In one or more embodiments, louver frame (200) includes rotation members (202). In one or more embodiments, rotation members (202) may be constructed of any material (e.g., polymer, metal, etc.) or any combination of materials. In one or more embodiments, rotation members (202) are any components and/or structures that couple a louver to louver frame (200), and allow louvers (204) to rotate about an axis of rotation. For example, rotation members (202) may be hinge joints (discussed above in the description of FIG. 1B). Rotation members may be any other type of coupling feature that allows louver rotation without departing from the scope of embodiments discussed herein.

In one or more embodiments, louver frame (200) is coupled to any number of louvers (e.g., louvers (204)). In one or more embodiments, louvers (204) may be constructed of any material (e.g., polymer, metal, etc.) or any combination of materials. In one or more embodiments, louvers (204) are any components and/or structures that couple to louver frame (200) via rotation members (202), and rotate about an axis of rotation. For example, louvers (204) may be coupled to louver frame (200) by hinge joints (discussed above in the description of FIG. 1B). In one or more embodiments, louvers (204) are configured to rotate depending on the speed of an airflow (e.g., volumetric flow rate) to which louvers are subjected (thereby applying a force to the louvers).

In one or more embodiments, for a given airflow direction, caused by a fan, louvers (204) are configured to open by rotating to an equilibrium angle that depends on the flow rate of the airflow provided by the fan and/or to which louvers (204) are otherwise subjected. In one or more embodiments, louvers (204) are configured to open to a maximum angle of 90 degrees when subjected to airflow in a given direction at or above a certain flow rate. In one or more embodiments, louvers (204) are configured to open to angles less than 90 degrees when subjected to airflows of lesser flow rates in the given direction. In one or more embodiments, louvers are configured to close (e.g., be positioned perpendicular to an airflow) when subjected to no airflow or to an airflow that is in a direction reverse from that a fan is intended to provide.

While FIG. 2A shows a configuration of components, other configurations may be used without departing from the scope of embodiments described herein. For example, while FIG. 2A shows three louvers, there may be any number of louvers coupled to a louver frame. Accordingly, embodiments disclosed herein should not be limited to the configuration of components shown in FIG. 2A.

Figure 2B:
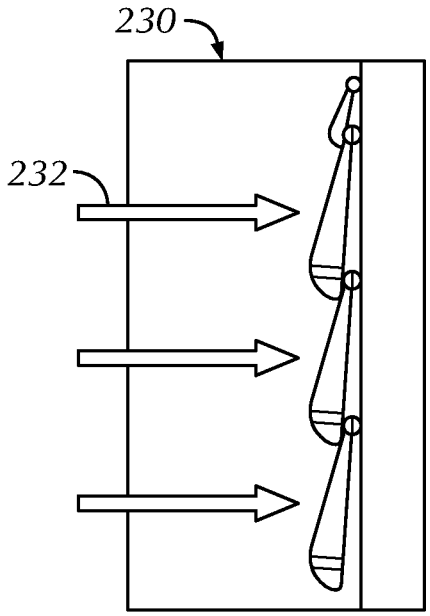
FIG. 2B shows a side view of louvers in a louver frame subjected to a reverse airflow in accordance with one or more embodiments described herein.

FIG. 2B shows a side view of louvers in a louver frame subjected to a reverse airflow in accordance with one or more embodiments described herein. The devices/components shown in FIG. 2B and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 2B.

As shown in FIG. 2B, the system includes louver module (230) and reverse airflow direction (232). Each of these components is described below.

In one or more embodiments, louver module (230) includes a louver frame to which louvers are coupled via rotation members, as discussed above in the descriptions of FIG. 1C and FIG. 2B, above. In one or more embodiments, louver module (230) is configured to be coupled to a fan module (not shown) that includes a fan designed to cause an airflow in a forward airflow direction.

In the example scenario shown in FIG. 2B, however, instead of an airflow in a forward airflow direction, there is a reverse airflow (232) in a reverse airflow direction. Such a scenario may exist, for example, when a fan or entire fan module has failed for any reason. In one or more embodiments, when subjected to a force applied by reverse airflow (232), the louvers rotate to a closed position to reduce or prevent the reverse airflow (232) from causing airflow in the reverse direction. For example, the closing of the louvers may prevent reverse airflow into a device, which may negatively impact the performance of components within a device that a failed fan is intended to cool when operating properly.

While FIG. 2B shows a configuration of components, other configurations may be used without departing from the scope of embodiments described herein. Accordingly, embodiments disclosed herein should not be limited to the configuration of components shown in FIG. 2B.

Figure 2C:
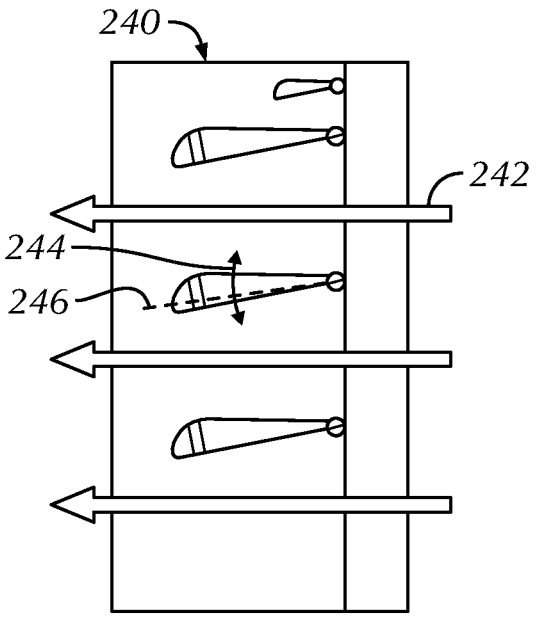
FIG. 2C shows a side view of louvers in a louver frame subjected to a forward airflow in accordance with one or more embodiments described herein.

FIG. 2C shows a side view of louvers in a louver frame subjected to a forward airflow in accordance with one or more embodiments described herein. The devices/components shown in FIG. 2C and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 2C.

As shown in FIG. 2C, the system includes louver module (240), forward airflow (242), equilibrium angle (246), and oscillation (244). Each of these components is described below.

In one or more embodiments, louver module (240) includes a louver frame to which louvers are coupled via rotation members, as discussed above in the descriptions of FIG. 1C and FIG. 2B, above. In one or more embodiments, louver module (240) is configured to be coupled to a fan module (not shown) that includes a fan designed to cause forward airflow (242) in a forward airflow direction.

In the example scenario shown in FIG. 2C, there is a forward airflow (242) in a forward airflow direction. Such a scenario may exist, for example, when a fan or entire fan module is operating properly to provide forward airflow (242). In one or more embodiments, when subjected to a force applied by forward airflow (242), the louvers rotate to an open position. In one or more embodiments, the louvers rotate about an axis to open to equilibrium angle (246). In one or more embodiments, equilibrium angle (246) is an angle at which it is desired for a louver to open to when subjected to a given force by a forward airflow (242). In one or more embodiments, a higher force applied by forward airflow (242) results in a larger angle of opening of the louvers.

In one or more embodiments, the force caused by forward airflow (242) may cause the louvers to open, but the angle of opening of the louvers experience an oscillation (244) about equilibrium angle (246). In one or more embodiments, the oscillation (244) is the angle of the louver alternating between being larger and smaller than equilibrium angle (246). As an example, forward airflow (242) may not provide a perfectly constant force to the louvers. Said another way, forward airflow (242) may subject the louvers to a force that varies slightly, which may lead to oscillation (244) of the louvers.

While FIG. 2C shows a configuration of components, other configurations may be used without departing from the scope of embodiments described herein. Accordingly, embodiments disclosed herein should not be limited to the configuration of components shown in FIG. 2C.

Figure 2D:
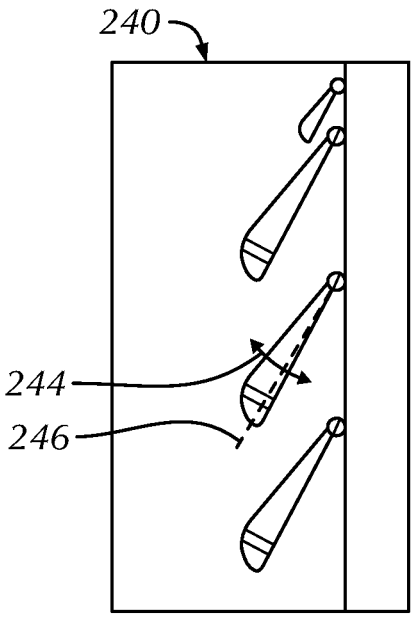
FIG. 2D shows a side view of louvers in a louver frame subjected to a forward airflow in accordance with one or more embodiments described herein.

FIG. 2D shows a side view of louvers in a louver frame subjected to a forward airflow in accordance with one or more embodiments described herein. The devices/components shown in FIG. 2D and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 2D.

As shown in FIG. 2D, the system includes louver module (240), forward airflow (242), equilibrium angle (246), and oscillation (244). Each of these components is described below.

In one or more embodiments, louver module (240) includes a louver frame to which louvers are coupled via rotation members, as discussed above in the descriptions of FIG. 1C and FIG. 2B, above. In one or more embodiments, louver module (240) is configured to be coupled to a fan module (not shown) that includes a fan designed to cause forward airflow in a forward airflow direction.

In the example scenario shown in FIG. 2D, there is a forward airflow in a forward airflow direction that applies a force to the louvers that is less than the force applied by the forward airflow shown in FIG. 2C. Such a scenario may exist, for example, when a fan or entire fan module is operating properly to provide forward airflow (242), but the rotational speed of the fan is lower because less cooling is needed. In one or more embodiments, when subjected to a lower force applied by a forward airflow, the louvers rotate to an open position at a lower angle than when subjected to a higher force. In one or more embodiments, the louvers rotate about an axis to open to equilibrium angle (246). In one or more embodiments, equilibrium angle (246) is an angle at which it is desired for a louver to open to when subjected to a given force by a forward airflow. In one or more embodiments, a lower force applied by forward airflow results in a smaller angle of opening of the louvers.

In one or more embodiments, the force caused by a forward airflow may cause the louvers to open, but the angle of opening of the louvers experience an oscillation (244) about equilibrium angle (246). In one or more embodiments, the oscillation (244) is the angle of the louver alternating between being larger and smaller than equilibrium angle (246). As an example, a forward airflow may not provide a perfectly constant force to the louvers. Said another way, a forward airflow may subject the louvers to a force that varies slightly, which may lead to oscillation (244) of the louvers.

While FIG. 2D shows a configuration of components, other configurations may be used without departing from the scope of embodiments described herein. For example, although FIG. 2C shows louvers opened to a relatively larger angle, and FIG. 2D shows louvers open to a relatively smaller angle, in embodiments described herein, louvers may open to any angle between 0 and 90 degrees, depending of the force applied by an airflow. Accordingly, embodiments disclosed herein should not be limited to the configuration of components shown in FIG. 2D.

Figure 3:
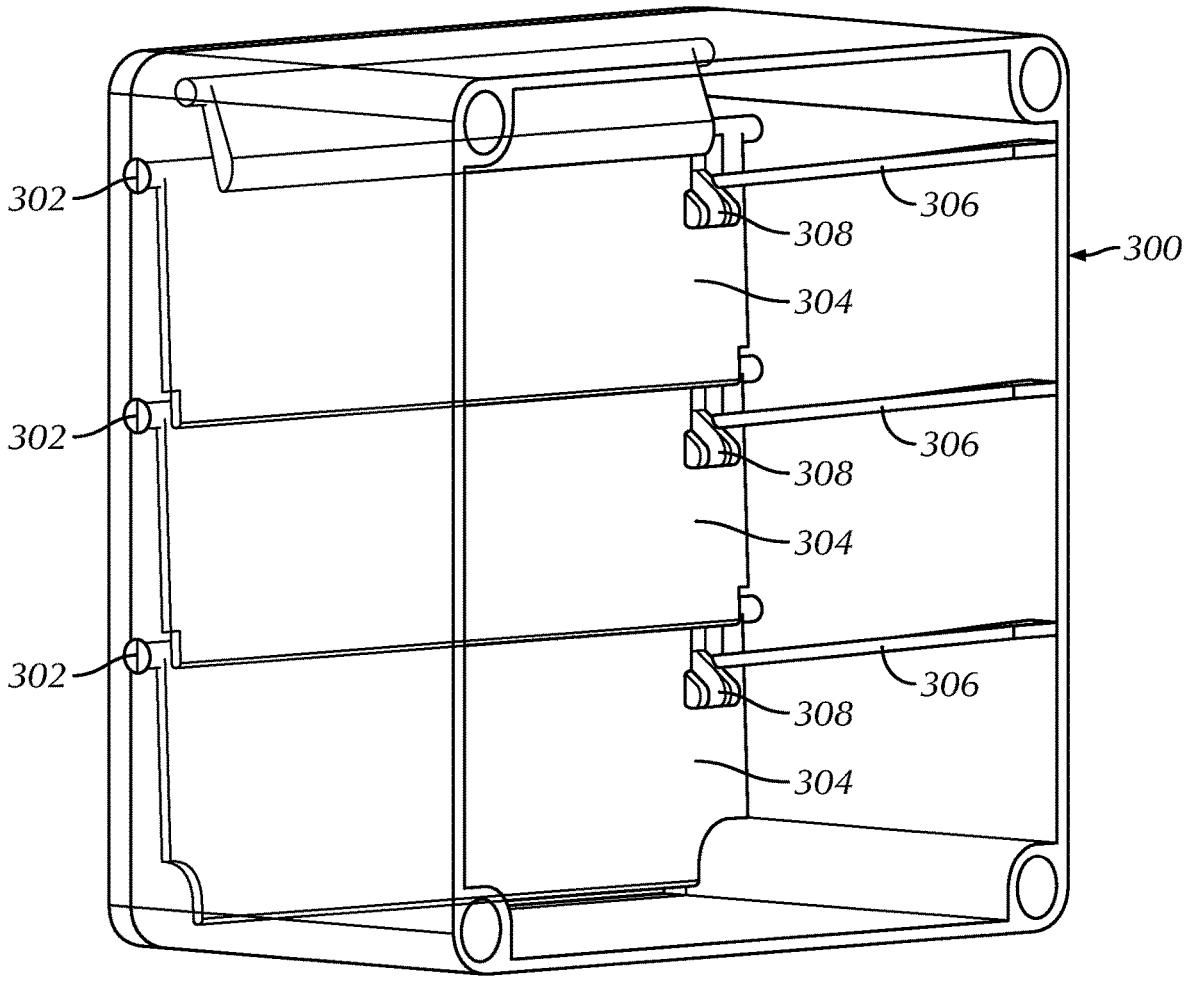
FIG. 3 shows a perspective view of louvers in a louver frame in accordance with one or more embodiments described herein.

FIG. 3 shows a perspective view of louvers in a louver frame in accordance with one or more embodiments described herein. The devices/components shown in FIG. 3 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 3.

As shown in FIG. 3, the system includes louver frame (300), rotation members (302), louvers (304), spring members (306), and spring member engagement features (308). Each of these components is described below.

In one or more embodiments, louver frame (300), rotation members (302), and louvers (304) are substantially similar to the louver frames, rotation members, and louvers discussed above in the descriptions of FIGS. 1A-2D.

In one or more embodiments, spring members (306) are coupled to louver frame (300). In one or more embodiments, spring members (306) may be any shape and size and constructed from any material (e.g., polymer, metal, etc.) capable of applying a force when in contract with spring member engagement features (308) of louvers (304). In one or more embodiments, spring members (306) are separate components coupled to louver frame (300) using any form of coupling between two components. In other embodiments, spring members (306) and louver frame (300) are each part of the same component. For example, the spring members (306), the louver frame (300), and the coupling between them may exist as a single polymer component constructed in the appropriate form.

In one or more embodiments, spring member engagement features (308) are features of louvers (304). In one or more embodiments, spring member engagement features (308) may be constructed from any material (e.g., polymer, metal, etc.) capable of interacting with a spring member (306), which applies a force when in contract with spring member engagement features (308) of louvers (304). In one or more embodiments, spring member engagement features (308) are separate components coupled to louvers (304) using any form of coupling between two components. In other embodiments, spring member engagement features (308) and a louver (304) are each part of the same component. For example, the spring member engagement features (308), the respective louver (304), and the coupling between them may exist as a single polymer component constructed in the appropriate form. A spring member engagement feature (308) may be any size, shape, or orientation that allows for engagement with spring members (306) of louver frame (300).

In one or more embodiments, spring members (306) and spring member engagement features (308) are configured to provide a force on the louvers to reduce or prevent oscillation about an equilibrium angle for a given forward airflow flow rate, which may prevent or reduce the chance that the wear and tear introduced by the oscillation prevents intended operation of louvers (304) to prevent reverse airflow while allowing forward airflow.

In one or more embodiments, the oscillation is reduced or prevented by using a spring member (306) as part of the louver frame (300) that engages with a spring member engagement feature (308) on the louver (304) to apply a variable force to the louver to reduce or prevent such oscillation. In one or more embodiments, the spring member (306) applies a force to the louver (304) to induce a counter moment that dampens out some or all of the oscillation. In one or more embodiments, the spring member (306) also changes the louver (304) natural frequency and provides a friction force at the louver (304) and spring member engagement feature that helps to reduce the oscillation. In one or more embodiments, the amount of force is calibrated based on experimentation that yields what the material properties of the spring member and its placement need to be to apply an appropriate amount of force at a given airflow speed.

In one or more embodiments, such as that shown in FIG. 3, when there is no airflow, or a reverse airflow, the spring members are not engaged with the spring member engagement features, and the louvers remain closed (e.g., orthogonal to the intended forward airflow direction), thereby reducing or preventing reverse airflow.

While FIG. 3 shows a configuration of components, other configurations may be used without departing from the scope of embodiments described herein. For example, there may be any number of louvers in a louver frame. As another example, the spring members coupled to the louver frame may be located anywhere on the louver frame. As another example, a spring member engagement feature may be located anywhere on a given louver. Accordingly, embodiments disclosed herein should not be limited to the configuration of components shown in FIG. 3.

Figure 4:
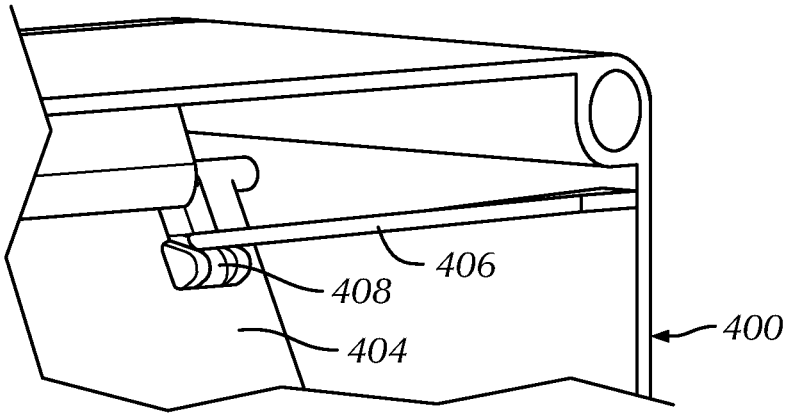
FIG. 4 shows a perspective view of a portion of a louver in a louver frame in accordance with one or more embodiments described herein.

FIG. 4 shows a perspective view of a portion of a louver in a louver frame in accordance with one or more embodiments described herein. The devices/components shown in FIG. 4 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 4.

As shown in FIG. 4, the system includes louver frame (400), louver (404), spring member (406), and spring member engagement feature (408). Each of these components is described below.

In one or more embodiments, louver frame (400), louver (404), spring member (406), and spring member engagement feature (408) are substantially similar to the louver frames, louvers, spring members, and spring member engagement features discussed above in the descriptions of FIGS. 1A-3.

In the example shown in FIG. 4, a closer view of the system is shown to illustrate when the spring member (406) begins to engage with the spring member engagement feature (408). In one or more embodiments, such engagement results when the louver (404) begins to rotate, or rotates to a certain minimum angle, when subjected to a force provided by a forward airflow. In one or more embodiments, such as that shown in FIG. 4, the spring member is a generally straight member prior to and at the initial engagement with the spring member engagement feature (408), and begins to apply a force to the louver (404) to dampen the oscillation near or at whatever equilibrium angle to which the louver has rotated as a result of a forward airflow.

While FIG. 4 shows a configuration of components, other configurations may be used without departing from the scope of embodiments described herein. For example, there may be any number of louvers in a louver frame. As another example, the spring members coupled to the louver frame may be located anywhere on the louver frame. As another example, a spring member engagement feature may be located anywhere on a given louver. Accordingly, embodiments disclosed herein should not be limited to the configuration of components shown in FIG. 4.

Figure 5:
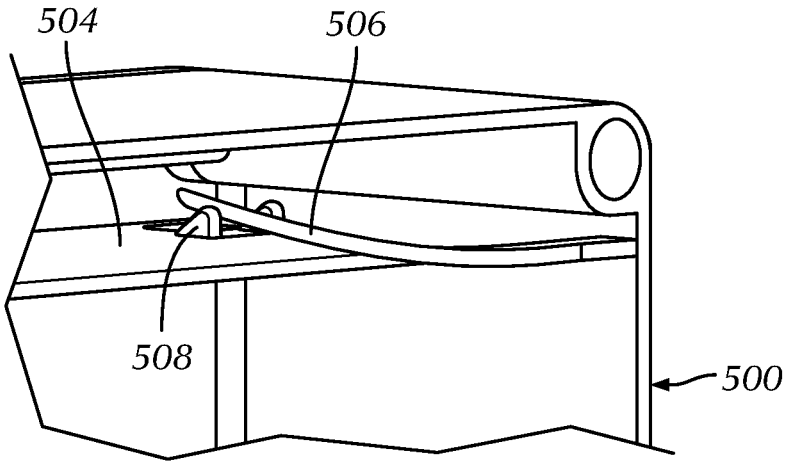
FIG. 5 shows a perspective view of a portion of a louver in a louver frame in accordance with one or more embodiments described herein.

FIG. 5 shows a perspective view of a portion of a louver in a louver frame in accordance with one or more embodiments described herein. The devices/components shown in FIG. 5 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 5.

As shown in FIG. 5, the system includes louver frame (500), louver (504), spring member (506), and spring member engagement feature (508). Each of these components is described below.

In one or more embodiments, louver frame (500), louver (504), spring member (506), and spring member engagement feature (508) are substantially similar to the louver frames, louvers, spring members, and spring member engagement features discussed above in the descriptions of FIGS. 1A-4.

In the example shown in FIG. 5, a closer view of the system is shown to illustrate when the spring member (506) is engaged with the spring member engagement feature (508). In one or more embodiments, such engagement results when the louver (504) has rotated to a larger angle than that shown in FIG. 4, when subjected to a larger force provided by a forward airflow. In one or more embodiments, such as that shown in FIG. 5, the spring member is a generally straight member prior to and at the initial engagement with the spring member engagement feature (508), and begins to apply a force to the louver (504) to dampen the oscillation near or at whatever equilibrium angle to which the louver has rotated as a result of a forward airflow. In one or more embodiments, the force applied by the spring member is shown in FIG. 5 as a result of a deformation of the spring member (506) to become curved while applying a force when attempting to revert to its initial straight configuration, which may be referred to as a spring force.

While FIG. 5 shows a configuration of components, other configurations may be used without departing from the scope of embodiments described herein. For example, there may be any number of louvers in a louver frame. As another example, the spring members coupled to the louver frame may be located anywhere on the louver frame. As another example, a spring member engagement feature may be located anywhere on a given louver. Accordingly, embodiments disclosed herein should not be limited to the configuration of components shown in FIG. 5.

Figure 6:
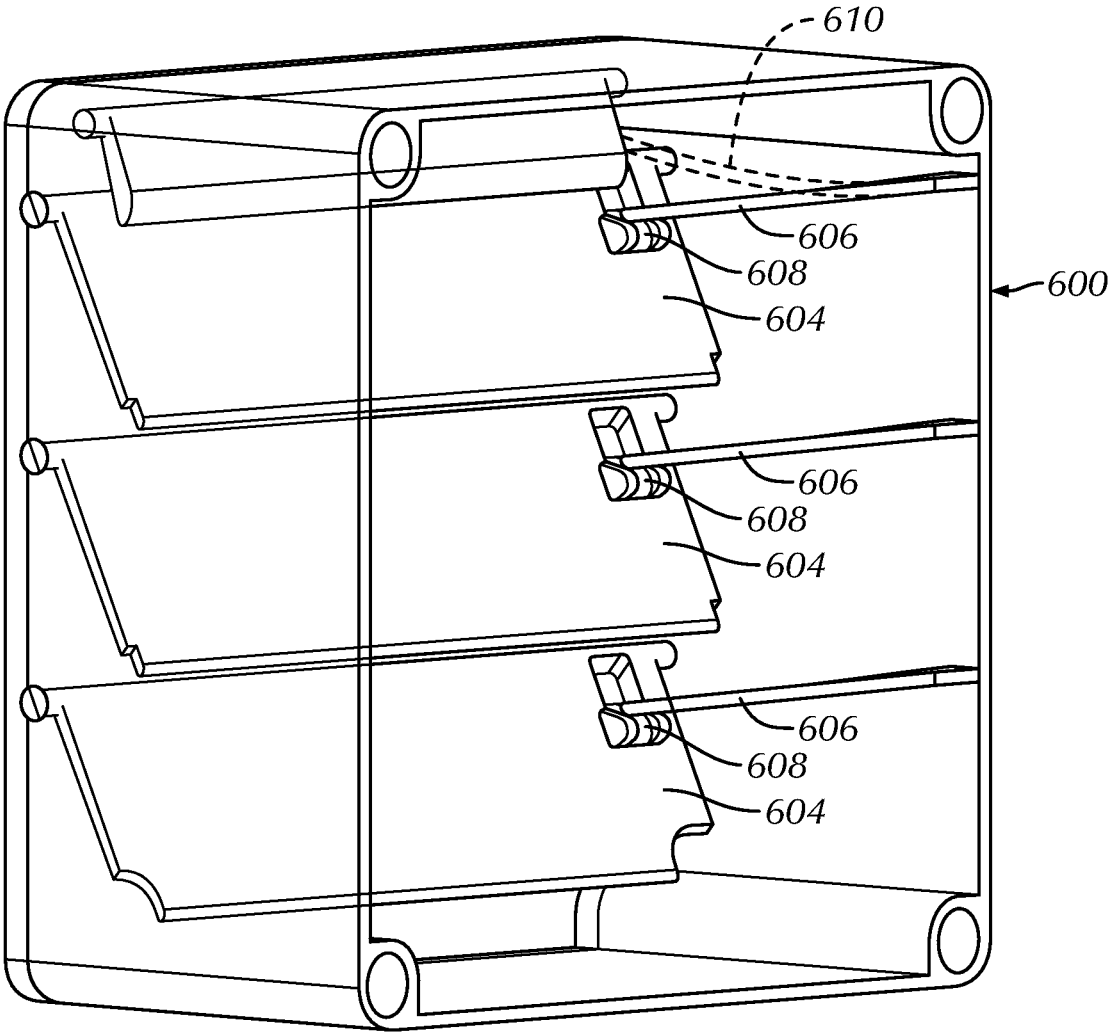
FIG. 6 shows a perspective view of louvers in a louver frame in accordance with one or more embodiments described herein.

FIG. 6 shows a perspective view of a portion of louvers in a louver frame in accordance with one or more embodiments described herein. The devices/components shown in FIG. 6 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 6.

As shown in FIG. 6, the system includes louver frame (600), louvers (604), spring members (606), and spring member engagement features (608), as well as a spring member max engagement position (610). Each of these components is described below.

In one or more embodiments, louver frames (600), louvers (604), spring members (606), and spring member engagement features (608) are substantially similar to the louver frames, louvers, spring members, and spring member engagement features discussed above in the descriptions of FIGS. 1A-5.

In the example shown in FIG. 6, a view of the system is shown to illustrate portions of three louvers (604) in louver frame (600). In one or more embodiments, the three louvers (604) shown in FIG. 6 have been rotated by the force of a forward airflow to the point that spring member engagement features (608) begin to engage spring members (606). Although so engaged, as shown in FIG. 6, spring members (606) have not substantially deformed to apply a force to louvers (604). In one or more embodiments, spring member max engagement position illustrates what position that a spring member may deform or flex to when the force from a forward airflow on louvers (604) is higher than what is shown in FIG. 6. Said another way, if there were a larger force on the louvers (604), the spring members (606) would apply an increasingly larger force on the louvers (604) via engagement with the spring member engagement features (608) until a position of maximum engagement is reached (i.e., 610), which may be configured such that the louvers do not open by rotating more than 90 degrees. In one or more embodiments, the force applied by spring members (606) is calibrated to dampen the oscillation about an equilibrium angle for a given force applied to louvers (604) by a forward airflow.

While FIG. 6 shows a configuration of components, other configurations may be used without departing from the scope of embodiments described herein. For example, there may be any number of louvers in a louver frame. As another example, the spring members coupled to the louver frame may be located anywhere on the louver frame. As another example, a spring member engagement feature may be located anywhere on a given louver. Accordingly, embodiments disclosed herein should not be limited to the configuration of components shown in FIG. 6.

Figure 7:
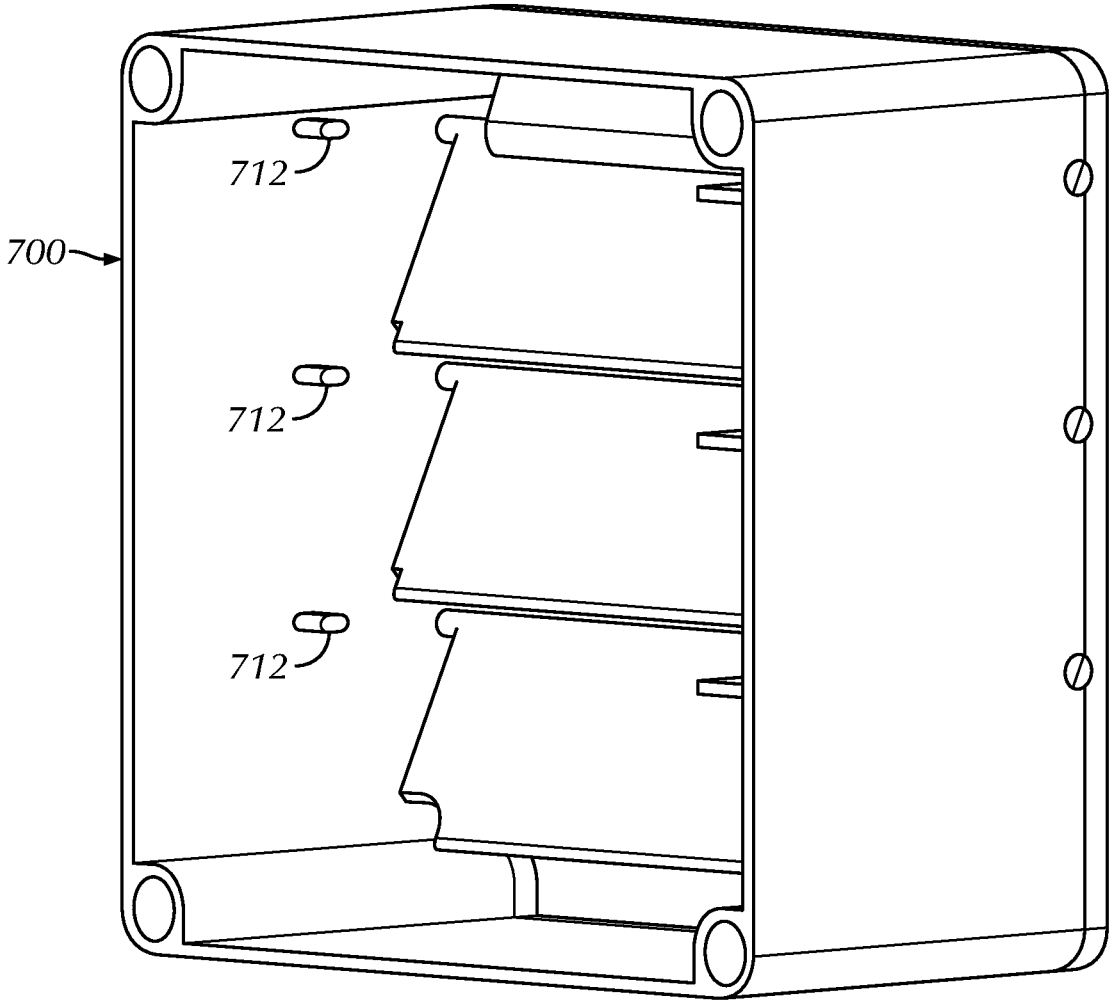
FIG. 7 shows a perspective view of louvers in a louver frame in accordance with one or more embodiments described herein.

FIG. 7 shows a perspective view of louvers in a louver frame in accordance with one or more embodiments described herein. The devices/components shown in FIG. 7 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 7.

As shown in FIG. 7, the system includes louver frame 700 and hard stop features (712). Each of these components is described below. Other features of the louver system of FIG. 7 may be present, but are not labeled to enhance the clarity of FIG. 7.

In one or more embodiments, louver frame (700) is substantially similar to the louver frames discussed above in the descriptions of FIGS. 1A-6.

In one or more embodiments, hard stop features (712) are coupled to louver frame (700). In one or more embodiments, hard stop features (712) may be any shape and size and constructed from any material (e.g., polymer, metal, etc.) capable of applying a force when in contract with any part of one or more louvers. In one or more embodiments, hard stop features (712) are separate components coupled to louver frame (700) using any form of coupling between two components. In other embodiments, hard stop features (712) and louver frame (700) are each part of the same component. For example, the hard stop features (712), the louver frame (700), and the coupling between them may exist as a single polymer component constructed in an appropriate form. In one or more embodiments, hard stop features (712) exist as a redundant solution to ensure that the louvers are unable to rotate past a certain angle of opening (e.g., 90 degrees). In one or more embodiments, hard stop features (712) exist in addition to the spring members and spring member engagement features described above in the descriptions of FIGS. 1A-6. In one or more embodiments, hard stop features (712) are configured to provide a hard stop of the rotation of the louvers at the desired angle of opening. Such hard stop features (712) may, for example, prevent rotation of louvers beyond 90 degrees, as additional rotation beyond that point may negatively impact the efficiency of a cooling system that includes such louvers.

While FIG. 7 shows a configuration of components, other configurations may be used without departing from the scope of embodiments described herein. For example, there may be any number of louvers in a louver frame, and, correspondingly, any number of hard stop features. Accordingly, embodiments disclosed herein should not be limited to the configuration of components shown in FIG. 7.

Figure 8:
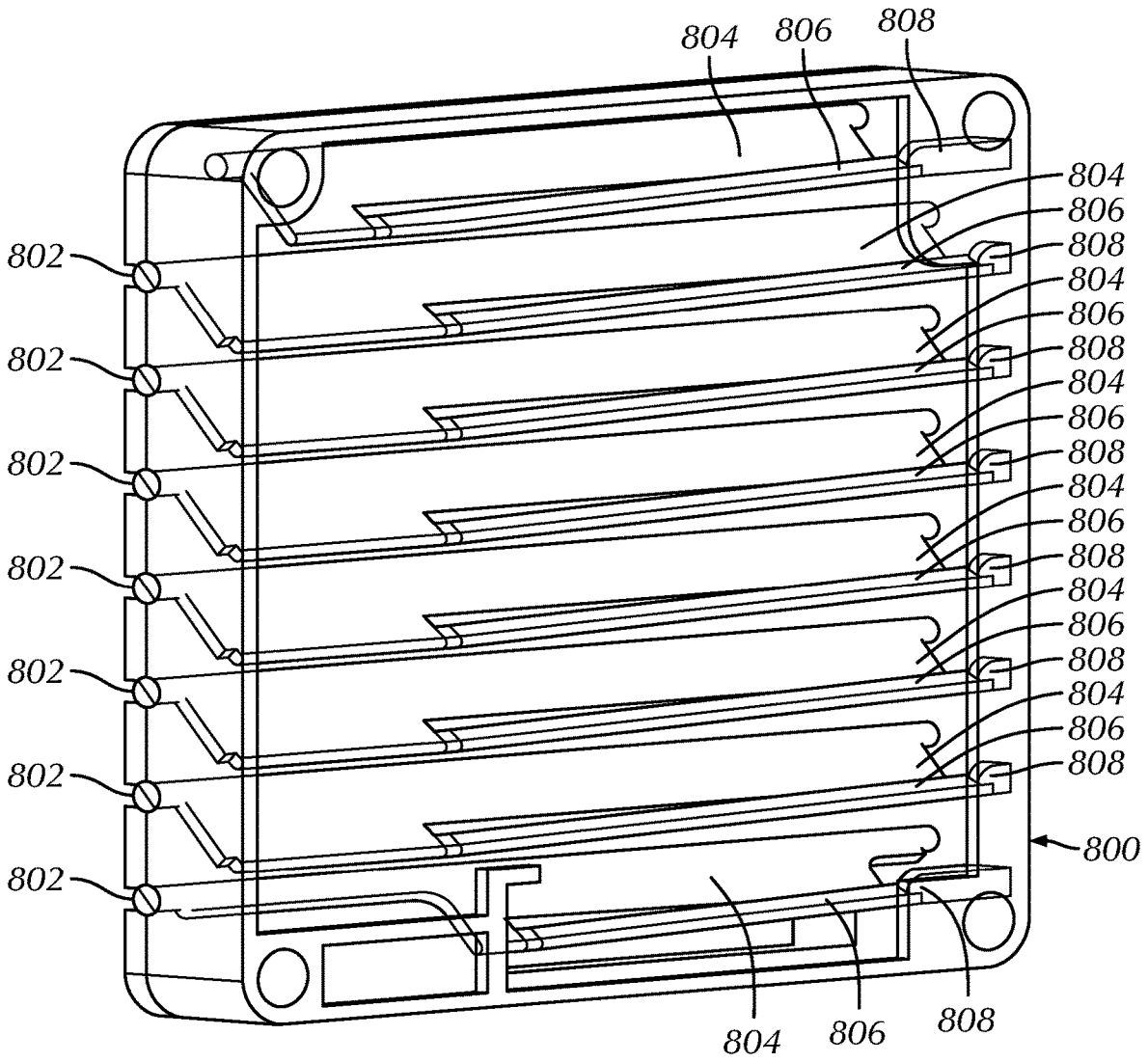
FIG. 8 shows a perspective view of louvers in a louver frame in accordance with one or more embodiments described herein.

FIG. 8 shows a perspective view of louvers in a louver frame in accordance with one or more embodiments described herein. The devices/components shown in FIG. 8 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 8.

As shown in FIG. 8, the system includes louver frame (800), rotation members (e.g., rotation member (802)), louvers (e.g., louver (804)), spring members (e.g., spring member (806)), and spring member engagement features (e.g., spring member engagement feature (808)). Each of these components is described below.

In one or more embodiments, louver frame (800), rotation member (802), and louver (804) are substantially similar to the louver frames, rotation members, and louvers discussed above in the descriptions of FIGS. 1A-2D.

In one or more embodiments, spring member (806) is coupled to louver (804). In one or more embodiments, spring member (806) may be any shape and size and constructed from any material (e.g., polymer, metal, etc.) capable of applying a force when in contract with spring member engagement features (808) of louver frame (800). In one or more embodiments, spring member (806) are separate components coupled to louver (804) using any form of coupling between two components. In other embodiments, spring member (806) and louver (804) are each part of the same component. For example, the spring members (806), the louver (804), and the coupling between them may exist as a single polymer component constructed in an appropriate form.

In one or more embodiments, spring member engagement feature (808) is a feature of louver frame (800). In one or more embodiments, spring member engagement feature (808) may be constructed from any material (e.g., polymer, metal, etc.) capable of interacting with a spring member (806), which applies a force when in contract with spring member engagement feature (808) of louver frame (800). In one or more embodiments, spring member engagement features (808) are separate components coupled to louver frame (800) using any form of coupling between two components. In other embodiments, spring member engagement feature (808) and a louver frame (800) are part of the same component. For example, the spring member engagement feature (808), the louver frame (800), and the coupling between them may exist as a single polymer component constructed in the appropriate form. A spring member engagement feature (808) may be any size, shape, or orientation that allows for engagement with spring member (806) of louver (804).

In one or more embodiments, spring member (806) and spring member engagement feature (808) are configured to provide a force on louver (804) to reduce or prevent oscillation about an equilibrium angle for a given forward airflow flow rate, which may prevent or reduce the chance that the wear and tear introduced by the oscillation prevents intended operation of louver (804) to reduce or prevent reverse airflow while allowing forward airflow.

In one or more embodiments, the oscillation is reduced or prevented by using a spring member (806) as part of the louver (804) that engages with a spring member engagement feature (808) on the louver frame (800) to apply a variable force to the louver to reduce or prevent such oscillation. In one or more embodiments, the spring member (806) applies a force to the louver (804) to induce a counter moment that dampens out some or all of the oscillation. In one or more embodiments, the spring member (806) also changes the louver (804) natural frequency and provides a friction force at the louver (804) and spring member engagement feature (808) that helps to reduce the oscillation. In one or more embodiments, the amount of force is calibrated based on experimentation that yields what the material properties of the spring member and its placement need to be to apply an appropriate amount of force at a given airflow speed.

In the example shown in FIG. 8, a view of the system is shown to illustrate when the spring member (806) begins to engage with the spring member engagement feature (808). In one or more embodiments, such engagement results when the louver (804) begins to rotate, or rotates to a certain minimum angle, when subjected to a force provided by a forward airflow. In one or more embodiments, such as that shown in FIG. 8, the spring member is a generally straight member prior to and at the initial engagement with the spring member engagement feature (808), and begins to apply a force to the louver (804) to dampen the oscillation near or at whatever equilibrium angle to which the louver has rotated as a result of a forward airflow, as shown by spring member (806) beginning to deform in FIG. 8.

While FIG. 8 shows a configuration of components, other configurations may be used without departing from the scope of embodiments described herein. For example, there may be any number of louvers in a louver frame. As another example, the spring members coupled to the louvers may be located anywhere on the louver. As another example, a spring member engagement feature may be located anywhere on the louver frame. Accordingly, embodiments disclosed herein should not be limited to the configuration of components shown in FIG. 8.

Figure 9:
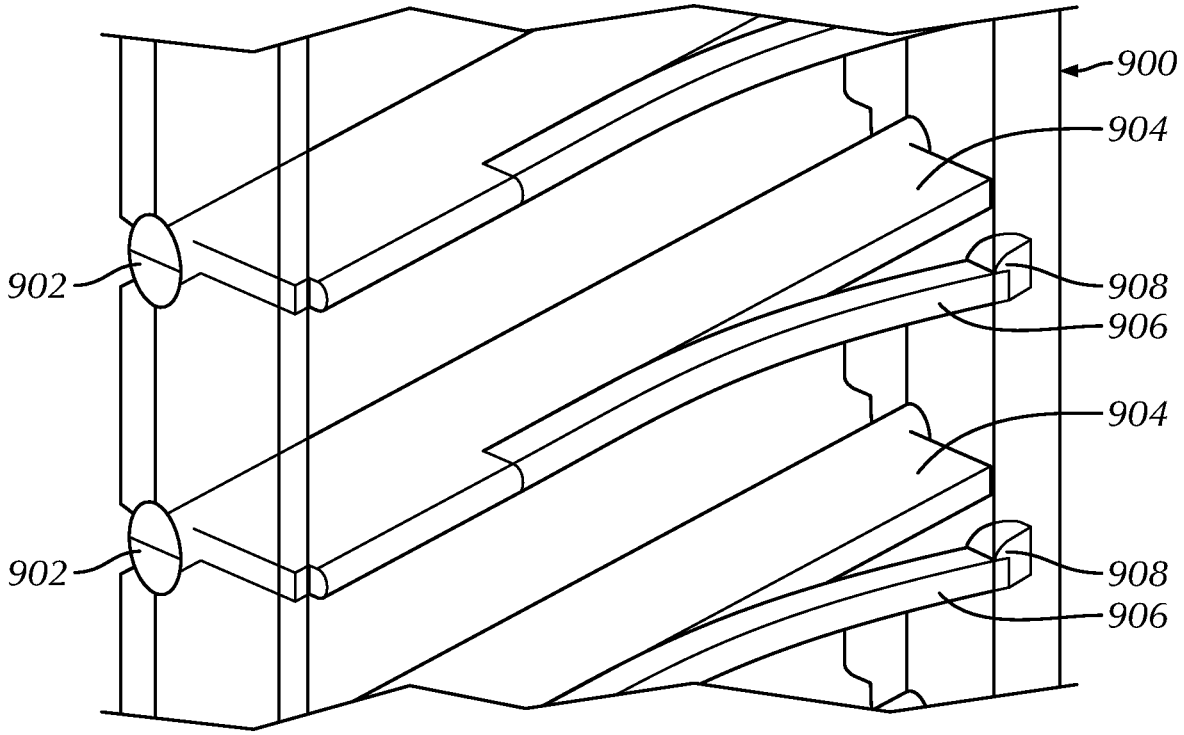
FIG. 9 shows a perspective view of portions of a louver in a louver frame in accordance with one or more embodiments described herein.

FIG. 9 shows a perspective view of a portion of louvers in a louver frame in accordance with one or more embodiments described herein. The devices/components shown in FIG. 9 and described below are each only one example of a particular device/component. One having ordinary skill in the art, and the benefit of this Detailed Description, will appreciate that the techniques described herein may apply to any number of different devices. Accordingly, embodiments described herein should not be considered limited to devices shown in FIG. 9.

As shown in FIG. 9, the system includes louver frame (900), rotation member (902), louver (904), spring member (906), and spring member engagement feature (908). Each of these components is described below.

In one or more embodiments, louver frame (900), rotation member (902), louver (904), spring member (906), and spring member engagement feature (908) are substantially similar to the louver frames, louvers, spring members, and spring member engagement features discussed above in the descriptions of FIGS. 1A-2D, and FIG. 8.

In the example shown in FIG. 9, a closer view of the system is shown to illustrate when the spring member (906) is engaged with the spring member engagement feature (908). In one or more embodiments, such engagement results when the louver (904) has rotated to a larger angle than that shown in FIG. 8, when subjected to a larger force provided by a forward airflow. In one or more embodiments, such as that shown in FIG. 9, the spring member is a generally straight member prior to and at the initial engagement with the spring member engagement feature (908), and begins to apply a force to the louver (904) to dampen the oscillation near or at whatever equilibrium angle to which the louver has rotated as a result of a forward airflow. In one or more embodiments, the force applied by the spring member is shown in FIG. 9 as a result of a deformation of the spring member (906) to become curved while applying a force when attempting to revert to its initial straight configuration, which may be referred to as a spring force.

While FIG. 9 shows a configuration of components, other configurations may be used without departing from the scope of embodiments described herein. For example, there may be any number of louvers in a louver frame. As another example, the spring members coupled to the louver may be located anywhere on the louver. As another example, a spring member engagement feature may be located anywhere on a louver frame. As another example, the embodiments shown in FIG. 8 and FIG. 9, with spring members as a part of louvers and spring member engagement features as part of a louver frame, may also have hard stop features, such as those shown in FIG. 7. Accordingly, embodiments disclosed herein should not be limited to the configuration of components shown in FIG. 9.

In the above description, numerous details are set forth as examples of embodiments described herein. It will be understood by those skilled in the art, and having the benefit of this Detailed Description, that one or more embodiments of embodiments described herein may be practiced without these specific details and that numerous variations or modifications may be possible without departing from the scope of the embodiments described herein. Certain details known to those of ordinary skill in the art may be omitted to avoid obscuring the description.

In the above description of the figures, any component described with regard to a figure, in various embodiments described herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named or similarly numbered components. Additionally, in accordance with various embodiments described herein, any description of the components of a figure is to be interpreted as an optional embodiment, which may be implemented in addition to, in conjunction with, or in place of the embodiments described with regard to a corresponding like-named or similarly numbered component in any other figure.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

As used herein, the phrase operatively connected, or operative connection, means that there exists between elements/components/devices a direct or indirect connection that allows the elements to interact with one another in some way. For example, the phrase 'operatively connected' may refer to any direct (e.g., wired directly between two devices or components) or indirect (e.g., wired and/or wireless connections between any number of devices or components connecting the operatively connected devices) connection. Thus, any path through which information may travel may be considered an operative connection.

As used herein, words that express a certain direction (e.g., forward, reverse, front, back, rear, etc.) are not intended to express that an airflow occurs in any given direction in a three dimensional space. Instead, such terms are intended to convey an airflow direction relative to components in a given figure, and/or to describe airflows that may occur in different directions (e.g., forward versus reverse).

While a limited number of embodiments have been described herein, those skilled in the art, having benefit of this disclosure, will appreciate that other embodiments can be devised which do not depart from the scope of the embodiments described herein. Accordingly, the scope of embodiments described herein should be limited only by the attached claims.

What is claimed is:

1. A system for controlling louver positions, the system comprising:

a louver frame;

a louver coupled to the louver frame via a rotation member and adapted to rotate at a louver side around an axis of rotation at the rotation member, wherein the louver comprises a spring member engagement feature; and a spring member coupled to the louver frame and adapted to engage with the spring member engagement feature of the louver and apply a force to the louver when a forward airflow is applied to the louver in a forward airflow direction, wherein the spring member is not engaged to the spring member engagement feature of the louver when there is no airflow.

2. The system of claim 1, wherein the spring member engages the spring member engagement feature of the louver when the forward airflow is greater than a lower airflow threshold.

3. The system of claim 2, wherein the force applied by the spring member to the louver increases as the forward airflow increases.

4. The system of claim 2, wherein the force applied to the louver by the spring member reduces louver oscillation when the forward airflow in the forward airflow direction is above a volumetric flow rate threshold.

5. The system of claim 1, wherein the louver frame comprises the louver stop adapted to prevent the louver from rotating past ninety degrees.

6. The system of claim 5, wherein, when the louver is rotated to ninety degrees, the louver is parallel to the forward airflow direction.

7. The system of claim 1, wherein the louver is orthogonal to the forward airflow direction when there is no forward airflow in the forward airflow direction.

8. The system of claim 1, wherein the louver is orthogonal to the forward airflow direction when a reverse airflow is applied to the louver in a reverse airflow direction.

9. The system of claim 1, wherein the louver frame is coupled to a fan module adapted to provide the forward airflow in the forward airflow direction when in operation.

10. The system of claim 1, wherein the spring member is parallel to the axis of rotation of the louver.

11. The system of claim 1, wherein the spring member is perpendicular to the axis of rotation of the louver.

12. A system for controlling louver positions, the system comprising:

a louver frame comprising a spring member engagement feature;

a louver coupled to the louver frame via a rotation member and adapted to rotate at a louver side around an axis of rotation at the rotation member, wherein the louver comprises a spring member; and the spring member of the louver adapted to engage with the spring member engagement feature of the louver frame and apply a force to the louver when a forward airflow is applied to the louver in a forward airflow direction, wherein the spring member is not engaged to the spring member engagement feature when there is no airflow.

13. The system of claim 12, wherein the spring member engages the spring member engagement feature when the forward airflow is greater than a lower airflow threshold.

14. The system of claim 13, wherein the force applied by the spring member to the louver increases as the forward airflow increases.

15. The system of claim 12, wherein the force applied to the louver by the spring member reduces louver oscillation when the forward airflow in the forward airflow direction is above a volumetric flow rate threshold.

16. The system of claim 12, wherein:

the louver frame comprises the louver stop adapted to prevent the louver from rotating past ninety degrees, and when the louver is rotated to ninety degrees, the louver is parallel to the forward airflow direction.

17. The system of claim 12, wherein:

the louver is orthogonal to the forward airflow direction when there is no forward airflow in the forward airflow direction, and the louver is orthogonal to the forward airflow direction when a reverse airflow is applied to the louver in a reverse airflow direction.

18. The system of claim 12, wherein the louver frame is coupled to a fan module adapted to provide the forward airflow in the forward airflow direction when in operation.

19. The system of claim 12, wherein the spring member is parallel to the axis of rotation of the louver.

20. A system for controlling louver positions, the system comprising:

a louver frame;

a louver coupled to the louver frame via a rotation member and adapted to rotate at a first louver side around an axis of rotation at the rotation member; and a spring member coupled at a first end to the louver and at a second end to the louver frame and adapted to apply a force to the louver when a forward airflow is applied to the louver in a forward airflow direction, wherein the force reduces louver oscillation at a volumetric airflow rate, wherein the spring member is not coupled to the louver when there is no airflow.

* * * * *